United States Patent [19]

Baxley, Jr. et al.

[11] Patent Number: 4,621,508

[45] Date of Patent: Nov. 11, 1986

[54] TEXTILE YARN CARRIER AND METHOD OF MANUFACTURING SAME

[75] Inventors: William H. Baxley, Jr., Hartsville; Noah Y. Giles, Jr., Union, both of S.C.

[73] Assignee: Sonoco Products Company, Hartsville, S.C.

[21] Appl. No.: 733,595

[22] Filed: May 13, 1985

[51] Int. Cl.[4] ..... D06B 5/18; B65H 75/22

[52] U.S. Cl. ..... 68/198; 242/118.11

[58] Field of Search ..... 68/198; 242/118.1, 118.11, 242/118.2; 210/489, 497.01

[56] References Cited

U.S. PATENT DOCUMENTS

| | | | |
|---|---|---|---|
| 2,654,124 | 10/1953 | Layte . | |
| 2,945,557 | 7/1960 | Powers . | |
| 3,126,306 | 3/1964 | Sherman . | |
| 3,563,491 | 2/1971 | Hahm | 242/118.11 |
| 3,695,443 | 10/1972 | Schmidt, Jr. | 210/497.01 X |
| 3,747,770 | 7/1973 | Zentis | 210/489 X |
| 3,753,534 | 8/1973 | Ono et al. | 242/118.11 |
| 3,830,373 | 8/1974 | Sixt et al. | 210/489 |
| 4,028,255 | 6/1977 | Bolto | 210/500 R |
| 4,172,788 | 10/1979 | Ingram | 210/500 R X |
| 4,181,274 | 1/1980 | Burchette, Jr. | 242/118.11 |
| 4,365,669 | 12/1982 | Wagner et al. | 166/231 |
| 4,385,480 | 5/1983 | Burchette, Jr. | 53/399 |
| 4,402,830 | 9/1983 | Pall | 210/457 |
| 4,427,818 | 1/1984 | Prusinski | 524/442 |
| 4,454,734 | 6/1984 | Marquis et al. | 68/198 |

FOREIGN PATENT DOCUMENTS

| | | | |
|---|---|---|---|
| 42324 | 12/1971 | Japan | 68/198 |

*Primary Examiner*—Philip R. Coe

*Attorney, Agent, or Firm*—Bell, Seltzer, Park & Gibson

[57] ABSTRACT

A textile yarn carrier and method of manufacturing same for use in dyeing or wet finishing of the textile yarn and being characterized by an improved construction which allows for economical material reclamation and reusage and improved yarn delivery from the surface thereof. The carrier includes a tubular core having passageways through the wall thereof for the passage of dye or other wet finishing baths and constructed of a specific reclaimable material. A filter sleeve is wound and secured around the outside of the tubular core without the use of glue or other adhesive materials and with the edges thereof overlapping, for preventing entrapment of the yarn in the passageways of the tubular core and for providing filtration of the dye or other wet finishing baths. The filter sleeve is constructed of the same specific reclaimable material as the tubular core so that the entire carrier may be ground-up and reused in constructing further carriers of the same specific material. The filter sleeve is ultrasonically sealed to the tubular core and to itself along the overlapping edges to eliminate obstacles to yarn delivery from the carrier.

4 Claims, 12 Drawing Figures

TEXTILE YARN CARRIER AND METHOD OF MANUFACTURING SAME

FIELD OF THE INVENTION

This invention relates to a textile yarn carrier and method of making same for use in dyeing or wet finishing the textile yarn and being characterized by an improved construction which allows for economical material reclamation and reusage and improved yarn delivery from the surface thereof.

BACKGROUND OF THE INVENTION

Textile yarn carriers for use in dyeing or wet finishing the textile yarn have usually been of the types known as "dye tubes" or "dye springs". Both of these types of carriers utilize a tubular core having passageways through the walls thereof for the passage of dye or other wet finishing baths and some of which additionally utilize a filter sleeve material secured around the outside of the tubular core for preventing entrapment of the yarn in the passageways of the tubular core and for providing filtration of the dye or other wet finishing baths.

Most recently, these tubular cores have been constructed of a molded plastic material, such as polypropylene, and the filter sleeve has been made of a cellulosic paper material. The paper filter sleeve material has been secured around the tubular core, usually by spiral or convolute winding, with the edges thereof overlapping and bonded by glue or other adhesive material to the tubular core and to itself along the overlapping edges. Also, heat bonding has been used to slightly melt the plastic core for bonding the sleeve material thereto.

With these prior constructions of textile yarn carriers two problems have been presented in textile manufacturing operations. The first of these problems is that the yarn carriers are normally used only once in a textile dyeing or finishing operation and are then discarded, although dye tubes are sometimes used more than once. No material reclamation and reusage was considered possible with these textile yarn carriers since the paper, and adhesive bonding material if used, would have to be removed from the plastic tubular core in order for the tubular core to be ground-up and reused in the formation of additional yarn carriers. The difficulty in removing the paper filter sleeve material, and adhesive bonding material if used, rendered any such reclamation and reusage uneconomical.

The second problem presented was inadequate bonding of the filter sleeve material to itself and to the tubular core through normal adhesive or glue application techniques, which resulted in "dog-ears" at the ends of the yarn carriers causing obstacles to delivery of yarn from the carriers after a dyeing or finishing operation.

OBJECT AND SUMMARY OF THE INVENTION

Accordingly, it is the object of this invention to provide a textile yarn carrier of the type utilizing a filter sleeve and method of manufacturing same which provides an improved construction allowing for economical material reclamation and reusage, while preferably also improving yarn delivery from the surface of the yarn carrier.

By this invention it has been found that the above object may be accomplished by a textile yarn carrier utilizing a tubular core constructed of a specific reclaimable material, such as polypropylene, and a filter sleeve secured without the use of glue or adhesives around the outside of the tubular core and being constructed of the same specific reclaimable material as the tubular core so that the entire carrier may be ground-up after use and reused in constructing further carriers of the same specific material. It has been found by this invention that spunbonded non-woven polypropylene material is suitable for such filter sleeve.

In considering how to bond the filter sleeve material to itself and to the tubular core, applicants experimented first with heat sealing, but found that this bonding technique distorted and melted the filter sleeve material unacceptably. Applicants then discovered that ultrasonic sealing allowed adequate bonding of the thermoplastic filter sleeve material to itself and to the plastic core without such excessive distortion and melting of the filter sleeve material, while providing sufficient sealing to eliminate the previous problems of "dog-ears" and, thus, improved the delivery of the yarn from the surface of the yarn carrier after use in a textile dyeing or wet finishing process.

BRIEF DESCRIPTION OF THE DRAWINGS

While some of the objects and advantages of this invention have been described above, other objects and advantages will appear as the description continues, when taken in conjunction with the accompanying drawings in which.

DETAILED DESCRIPTION OF PREFERRED EMBODIMENTS

Figure 1:
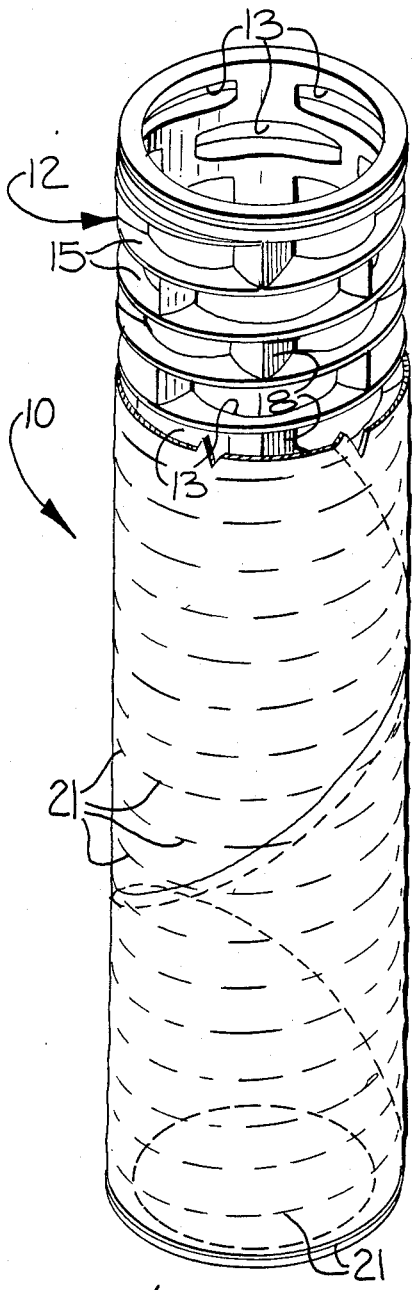
FIG. 1 is a perspective view of a textile yarn carrier in the form of a "dye spring" constructed in accordance with this invention and having a portion of the filter sleeve thereof broken away for illustration of the tubular core.
Figure 3:
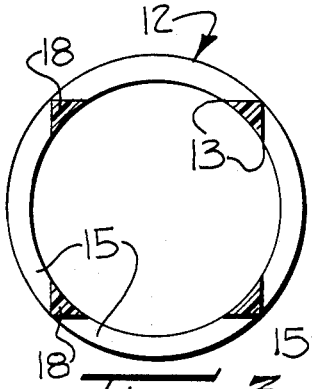
FIG. 3 is a sectional view, taken generally along the line 3—3 of FIG. 2.
Figure 4:
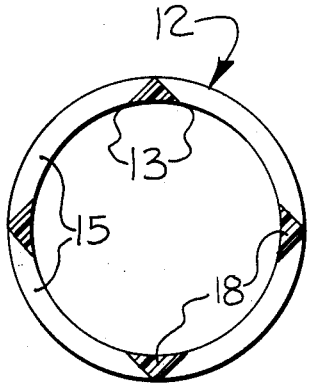
FIG. 4 is a sectional view, taken generally along the line 4—4 of FIG. 2.
Figure 2:
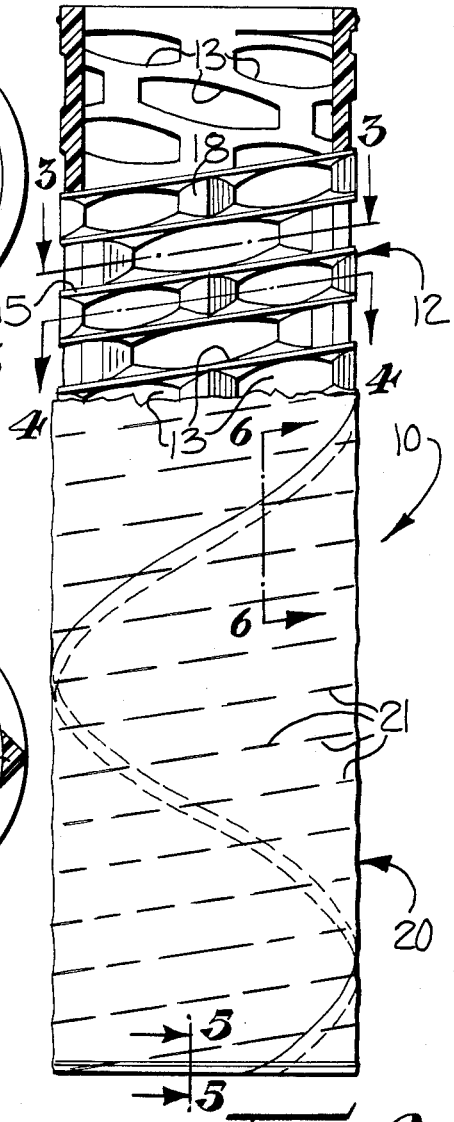
FIG. 2 is a side elevational view of the textile yarn carrier of FIG. 1.
Figure 5:
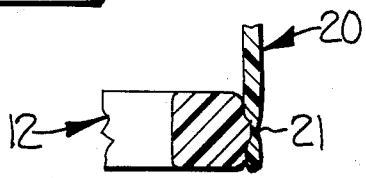
FIG. 5 is an enlarged sectional detail, taken generally along the line 5—5 of FIG. 2.
Figure 6:
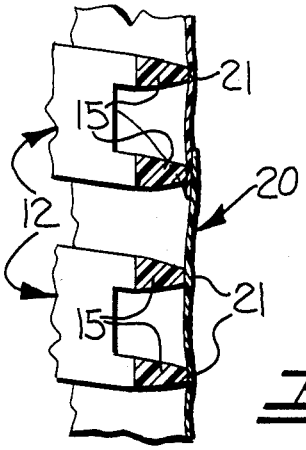
FIG. 6 is an enlarged sectional detail, taken generally along the line 6—6 of FIG. 2.

Referring now to the drawings, firstly to FIGS. 1–6, a textile yarn carrier 10 is illustrated therein for use in dyeing or wet finishing textile yarn (not shown) which is wound therearound in a previous textile winding operation.

This textile yarn carrier 10 includes a tubular core 12 having passageways 13 through the wall thereof for the passage of dye or other wet finishing baths and being constructed of a specific reclaimable material. The particular form of tubular core illustrated in FIGS. 1–6 to form a textile yarn carrier 12 in the form of a "dye spring" which is collapsible and includes upstanding ribs 15 extending generally helically around the core 12 in the longitudinal direction thereof to define an outside wall surface on the core, as may be clearly seen in FIGS. 1–4 and 6. These upstanding ribs 15 are interconnected by members 18. These members 18 are staggered in the spaces between helical runs of the ribs 15 so as to allow collapsing of the entire core 12 for purposes well understood by those with ordinary skill in the art and use of such collapsible "dye springs" as a textile yarn carrier.

The textile yarn carrier 10 further includes a filter sleeve 20 which in the preferred embodiments illustrated is spirally wound and secured around the outside of the tubular core 12 with the edges thereof overlapping, for preventing entrapment of the yarn in the passageways of the tubular core and for providing filtration of the dye or other wet finishing baths. It is to be understood, however, that the filter sleeve 20 could also be convolutely wound around the tubular core 12. The filter sleeve 20 is constructed of the same specific reclaimable material as the tubular core so that the entire carrier 10 may be ground-up and reused in constructing further carriers of the same specific material. The filter sleeve 20 is ultrasonically sealed to the tubular core 12 and to itself along the overlapping edges at areas where the filter sleeve 20 contacts the outside surface of the core 12 or upstanding ribs 15. This sealing eliminates obstacles, such as previous "dog-ears", in the filter sleeve 20 to improve yarn delivery from the carrier 10.

Preferably, the specific reclaimable material utilized for construction of the tubular core 12 and the filter sleeved 20 comprises polypropylene. This polypropylene material may be utilized to form a molded tubular core and may be utilized as a spunbonded non-woven material for the filter sleeve 20.

Figure 7:
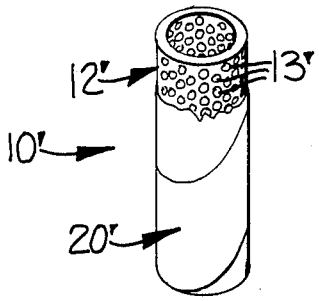
FIG. 7 is a reduced size perspective view of a textile yarn carrier in the form of a "dye tube" constructed in accordance with this invention.
Figure 9:
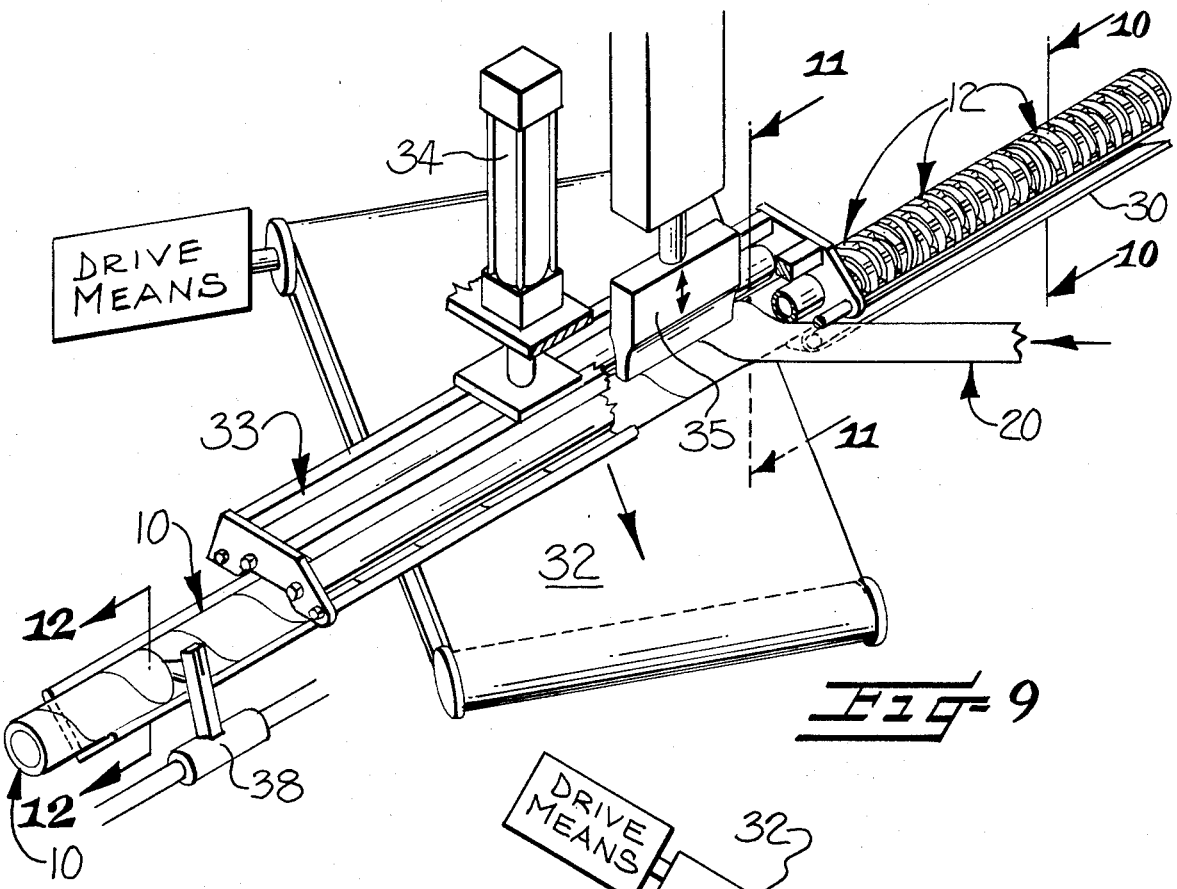
FIG. 9 is a schematic, somewhat diagrammatic, view of the mechanical operations involved in the method of manufacturing the textile yarn carrier of FIG. 1 in accordance with this invention.
Figure 8:
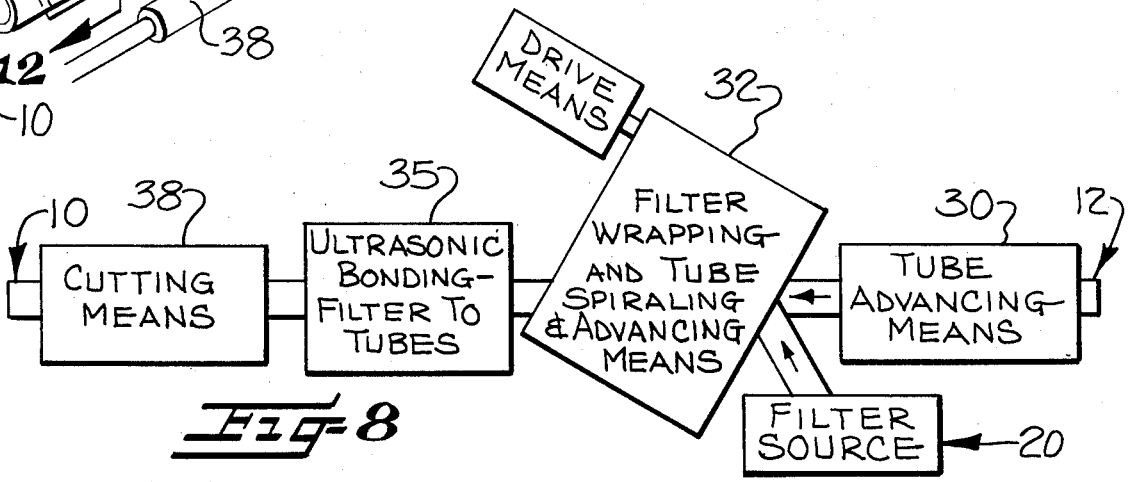
FIG. 8 is a schematic block diagram illustrating the steps of a method of manufacturing the textile yarn carrier of FIG. 1 in accordance with this invention.
Figure 10:
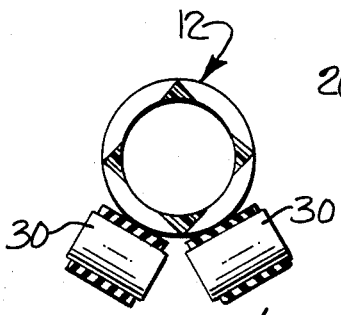
FIG. 10 is a sectional view, taken generally along the line 10—10 of FIG. 9.
Figure 11:
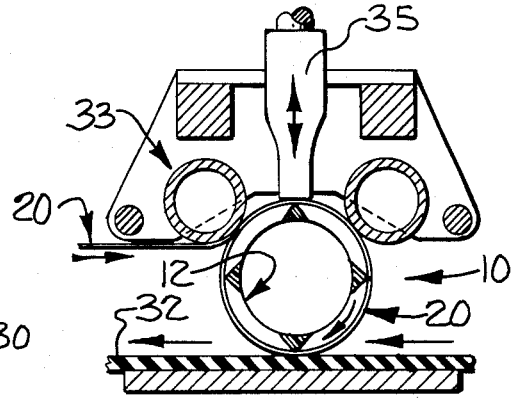
FIG. 11 is a sectional view, taken generally along the line 11—11 of FIG. 9.
Figure 12:
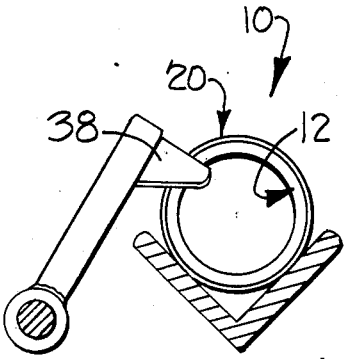
FIG. 12 is a sectional view, taken generally along the line 12—12 of FIG. 9.

Referring now to FIG. 7, there is shown therein a textile yarn carrier 10' constructed in accordance with this invention and utilizing a tubular core 12' in the form of a noncollapsible "dye tube" having passageways 13' therein. This embodiment of a textile yarn carrier 10' also utilizes a filter sleeve 20' of the same specific reclaimable material as the core 12' and wrapped and ultrasonically secured therearound.

Referring now to FIGS. 8–12, schematic apparatus is shown therein for illustrating a method of manufacturing a textile yarn carrier 10 of the improved construction of this invention and specifically in the form of a "dye spring" type of carrier.

As shown therein, tubular cores 12 are provided of a specific reclaimable material, preferably molded polypropylene. The tubular cores 12 are fed forwardly in end-to-end arrangement in a longitudinal path of travel through the apparatus, such as by drive belts 30.

Continuous filter sleeve material 20 is fed from a supply (not shown) obliquely onto the tubular cores 12 and is spirally wrapped therearound, such as by an obliquely positioned drive belt 32 and roller mechanism 33 which is held in engagement with the core 12 by piston and cylinder device 34. The speed of longitudinal feed of the cores 12 is coordinated with the spiral wrapping means so that the edges of the filter sleeve material 20 are overlapped and cover the outside of the tubular cores 12.

The filter sleeve material 20 is ultrasonically bonded to the tubular cores 12 and to itself along the overlapping edges of the filter sleeve material 20 at the outside wall areas formed by the helical ribs 15 of the tubular cores 12. This ultrasonic bonding is preferably accomplished by a conventional ultrasonic mechanism including a horn 35. The ribs 15 forming the outside wall area of the cores 12 act as an anvil to effect ultrasonic bonding of the filter sleeve material 20, which is thermoplastic and preferably in the form of spunbonded nonwoven material in a manner well understood by those with ordinary skill in the art. Ultrasonic bonding does not occur in the areas of the passageways 13 in the tubular cores 12 because there is no surface acting as an anvil to cooperate with the ultrasonic horn 35 to ultrasonically fuse and bond the filter sleeve material 20.

Thereafter, the bonded filter sleeve material 20 is cut between the tubular cores 12, such as by a cutting mechanism 38, to separate individual textile yarn carriers 10.

Thus, this invention has provided an improved construction of a textile yarn carrier 10 and method of manufacturing same which allows for economical material reclamation and reusage, not heretofore possible with prior textile yarn carrier constructions utilizing filter sleeves, and which provides improved yarn delivery from the surface of such carrier 10 by eliminating heretofore present obstacles on the surface of the yarn carrier.

In the drawings and the detailed description set forth above, preferred embodiments of this invention have been described and, although specific terms are employed, they are used in a generic and descriptive sense only and not for purposes of limitation.

What is claimed is:

1. A textile yarn carrier for use in dyeing or wet finishing the textile yarn and being characterized by an improved construction which alJows for economical material reclamation and usage and improved yarn delivery from the surface thereof; said yarn carrier consisting of only components of the same specific thermoplastic reclaimable material so that the entire yarn carrier can be ground-up and reused in constructing further yarn carriers of the same specific material; said components comprising a tubular core having passageways through the wall thereof for the passage of dye or other wet finishing baths, a filter sleeve means wound around the outside of said tubular core and having overlapping edges for receiving textile yarn around the outside surface thereof and for preventing entrapment of the yarn in said passageways of said tubular core and for providing filtration of the dye or other wet finishing baths, and ultrasonically formed means for sealing said sleeve means to said tubular core and to itself along said overlapping edges to eliminate obstacles to yarn delivery from said carrier.

2. A textile yarn carrier, as set forth in claim 1, in which the specific reclaimable material utilized for construction of said tubular core and said filter sleeve comprises polypropylene.

3. A textile yarn carrier, as set forth in claim 2, in which said tubular core comprises molded polypropylene material, and said filter sleeve comprises spunbonded non-woven polypropylene material.

4. A textile yarn carrier, as set forth in claim 1, in which said tubular core comprises a collapsible spring having upstanding ribs extending generally helically around said core in the longitudinal direction thereof to define the outside wall surface on said core, and in which said ultrasonically formed means seals said filter sleeve to said core and to itself along the overlapping edges at spaced areas of contact with said outside wall surface defined by said upstanding ribs.

* * * * *